US008051884B2

(12) United States Patent
Reuter

(10) Patent No.: US 8,051,884 B2
(45) Date of Patent: Nov. 8, 2011

(54) DEVICE FOR COMBINING COMPONENTS BY MEANS OF NEGATIVE PRESSURE UNDER STERILE CONDITIONS

(75) Inventor: Uwe Reuter, Wohratal (DE)

(73) Assignee: CSL Behring GmbH, Marburg (DE)

( * ) Notice: Subject to any disclaimer, the term of this patent is extended or adjusted under 35 U.S.C. 154(b) by 285 days.

(21) Appl. No.: 12/375,046

(22) PCT Filed: Jul. 18, 2007

(86) PCT No.: PCT/EP2007/006378

§ 371 (c)(1),
(2), (4) Date: Jan. 26, 2009

(87) PCT Pub. No.: WO2008/012018

PCT Pub. Date: Jan. 31, 2008

(65) Prior Publication Data

US 2009/0320959 A1 Dec. 31, 2009

(30) Foreign Application Priority Data

Jul. 27, 2006 (DE) ..... 10 2006 035 545

(51) Int. Cl.
*B65B 1/04* (2006.01)

(52) U.S. Cl. ..... 141/329; 141/330; 604/413; 206/222; 222/83; 222/85

(58) Field of Classification Search ..... 141/59, 141/330, 329; 53/513; 604/412–413
See application file for complete search history.

(56) References Cited

U.S. PATENT DOCUMENTS

| | | | | |
|---|---|---|---|---|
| 3,987,791 | A | 10/1976 | Chittenden et al. | |
| RE29,656 | E * | 6/1978 | Chittenden et al. | 604/413 |
| 4,697,622 | A * | 10/1987 | Swift et al. | 141/1 |
| 5,060,704 | A | 10/1991 | Rohrbough | |
| 5,445,631 | A * | 8/1995 | Uchida | 604/412 |
| 5,743,312 | A | 4/1998 | Pfeifer et al. | |
| 6,021,824 | A * | 2/2000 | Larsen et al. | 141/329 |
| 6,478,771 | B1 | 11/2002 | Lavi et al. | |
| 2004/0225274 | A1 | 11/2004 | Jansen et al. | |

FOREIGN PATENT DOCUMENTS

| | | |
|---|---|---|
| DE | 38 17 101 A1 | 11/1989 |
| EP | 0 737 467 A1 | 10/1996 |
| EP | 1 454 650 A1 | 9/2004 |
| WO | WO-96/26702 A1 | 9/1996 |

* cited by examiner

*Primary Examiner* — Dinh Nguyen
*Assistant Examiner* — Jennifer Gordon
(74) *Attorney, Agent, or Firm* — Birch, Stewart, Kolasch & Birch, LLP

(57) ABSTRACT

The invention relates to a device for combining two components. A first container accommodates the first component, which is liquid, and a second container accommodates a second, solid or liquid component under negative pressure. A body is provided with a first holder for the first container, in the region of the closure of the latter, and with a second holder for the second container, in the region of the closure of the latter. Displaceable means for piercing the closures are provided within the body. In the case of such a device, the invention provides that the body has two slides mounted in a displaceable manner in it, wherein each slide accommodates a cannula for piercing the respective closure, the cannulas are connected, in the region of their ends directed away from the closure, to an element which connects the cannulas in a liquid-tight manner, and actuating means are provided for moving the slides in the direction of the closures for the purpose of piercing the closures.

11 Claims, 3 Drawing Sheets

Figure 1:
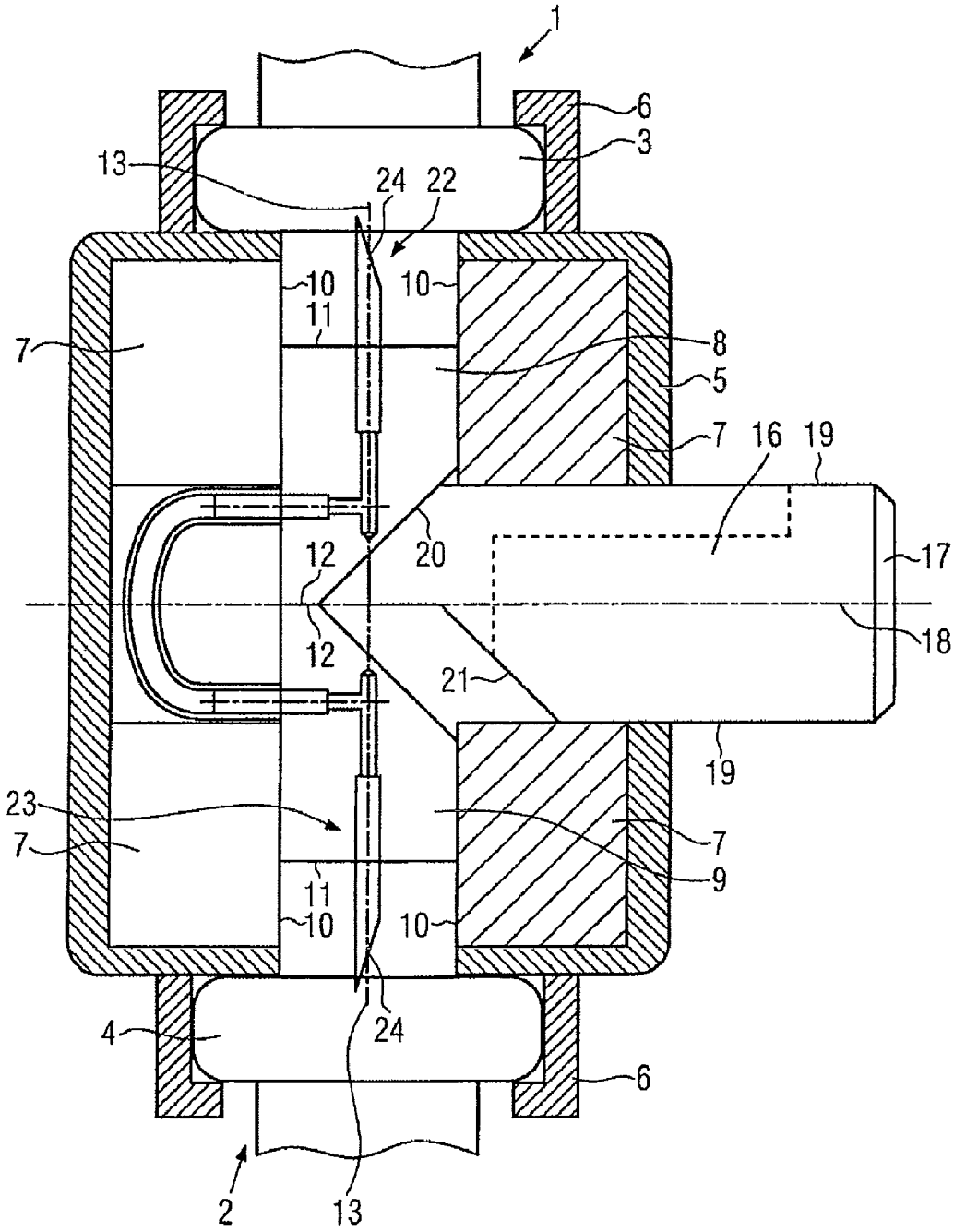

DEVICE FOR COMBINING COMPONENTS BY MEANS OF NEGATIVE PRESSURE UNDER STERILE CONDITIONS

The invention relates to a device for combining a first liquid component and a second solid or liquid component by means of negative pressure under sterile conditions, said device being provided with a first container which holds the first component and a second container which holds the second component and is under negative pressure, with a body having a first holder for the first container in the region of its closure and a second holder for the second container in the region of its closure, and with displaceable means arranged inside the body which are intended for piercing the closures, wherein the means comprise at least one cannula.

Such a device is known from EP 0 737 467 A1. It comprises a rotationally symmetrical hollow body. A single cannula is held in a cannula support. This support takes the form of a plate-shaped body which is oriented perpendicularly to the longitudinal direction of the body accommodating the two containers and which is connected to the inner wall of the hollow body via retaining webs. The closure of the respective container, which takes the form of a bottle, is a rubber stopper which is retained by means of a crimp cap. The bottle is fitted into and retained by the hollow body in the region of the respective crimp cap. The cannula support is positioned in the region halfway along the length of the hollow body. The second container, after being fitted into the hollow body, makes contact with stops belonging to the hollow body such that it cannot be inserted any further in the direction of the cannula into the hollow body. The first container is held in a preassembled position in a portion of the hollow body that faces the actual opening region of the hollow body, and an inner annular bead oriented parallel to the cannula support projects into the displacement path of the crimp cap and hence defines the assembly position. When the transfer system composed of the two bottles and the hollow body along with its cannula support and cannula is in this preassembled position, the crimp caps, and thus the rubber stoppers for closing the bottles, are situated at a slight distance from the two ends of the cannula. In this state, the transfer system has already been sealed into a peelable outer packaging and sterilized at the pharmaceutical manufacturer's premises. With the device unpacked, the components are combined by pushing the first container further into the hollow body, in which process the cannula penetrates the closure stopper of this container. This is possible because the penetrating force of the cannula into or through the rubber stopper of this container is less than the force which is required to separate the cannula support attached via the retaining webs to the hollow body from this hollow body. Once the rubber stopper of the first container is pierced, the crimp cap of this container comes into contact with the cannula support, with the result that the pushing force exerted manually on this container to push the container into the hollow body is transmitted directly to the cannula support. When a suitably high manual force is applied, the retaining webs tear such that the first container, together with the cannula support and hence the cannula, is displaced further in the direction of the second container inside the hollow body, with the cannula thereby piercing the rubber stopper of this second container. The negative pressure prevailing in the second container sucks the fluid from the first container into the second container and results in the solid or liquid component contained therein being dissolved and/or thoroughly mixed.

Because of the way in which the cannula support is attached to the hollow body, the device described is quite complicated from a structural and process engineering point of view; moreover, the force required to penetrate the rubber stopper, which depends particularly on the hardness of the rubber stopper and the geometry of the cannula, must be precisely tailored to the tear strength of the cannula support. If the closures of the containers are not punctured in a defined manner, it is not possible to ensure reliable transfer of the liquid.

Further devices for combining liquid or liquid/solid components contained in containers are described in DE 38 17 101 A1, U.S. Pat. Nos. 3,987,791 and 5,060,704. In these documents, the respective device comprises a single cannula.

The object of the present invention is to develop a device of the initially mentioned type in such a way that it can be produced simply and cost-effectively using fewer, simply designed components while having a compact design and allowing the liquid to be transferred in an easy, rapid and reliable manner.

The object is achieved in that the body comprises two sliding members which are mounted displaceably therein, wherein each sliding member accommodates a cannula for piercing the respective closure, the cannulas are connected, in the region of their ends which face away from the closures, to an element which connects the cannulas in a liquid-tight manner, and actuating means are provided for moving the sliding members in the direction of the closures for the purpose of piercing the closures.

What is essential in the transfer system according to invention is that two displaceable sliding members are provided, with each sliding member having a cannula. This design makes it possible, by displacing the sliding members, for the closures to be punctured or pierced independently of one another, and hence, in particular, with a time offset relative to one another. Here, the sliding members are preferably displaced using an actuating means assigned to the two sliding members that takes the form of a push-button or sliding actuating member. The sliding members can be moved by the actuating means in a wide variety of ways. It is considered to be particularly advantageous for the respective sliding member to be provided on its side facing the actuating means with a bevel which can be actively engaged with a corresponding bevel of the actuating means.

The sliding members can be made to move one after the other in time in a simple manner by one active surface of the actuating means coming into contact with the facing active surface of the sliding member at an earlier time than the other active surface of the actuating means comes into contact with the facing active surface of the other sliding member. On the other hand, it is conceivable for the active surfaces of the actuating means to make simultaneous contact with the sliding members, but with these active surfaces being shaped differently such that one sliding member is displaced by a greater distance than the other sliding member when the actuating means is moved by a defined distance.

Provision is made in a particularly simply designed embodiment of the invention for the two sliding members to be mounted in a diametrically displaceable manner in the body. To puncture or pierce the closures of the containers, it is therefore only required to move the two sliding members away from one another.

It is advantageous for the shape of the body to be, in particular, rotationally symmetrical. This allows simple holding of containers which, as rotationally symmetrical bottles, are provided with a correspondingly shaped bottleneck and crimp cap for fixing the closure element, in particular a rubber stopper.

A particularly simple design of sliding member and actuating means is obtained if the working axis of the actuating means is arranged approximately perpendicularly to the adjusting axis of the sliding members. Provision is made in particular for the actuating means to be provided at its front end with bevels which interact with bevels of the sliding members. The sliding members are advantageously of identical design, in particular to keep the production costs low, and the actuating means has identical bevels which are arranged with an offset in the adjusting direction of the actuating means. Thus, one bevel of the actuating means comes into contact with the bevel of one sliding member earlier than the other bevel of the actuating means comes into contact with the bevel of the other sliding member.

Since the device according to the invention comprises two sliding members and each sliding member is assigned a cannula and, moreover, the sliding members are moved away from one another, whether diametrically or, for example, at an angle to one another, it is required to transfer the liquid from one cannula to the other cannula while the distance between the cannulas varies. This is achieved by the element provided according to the invention which connects the cannulas in a liquid-tight manner in the region of their ends which face away from the closures. According to a particular embodiment of the invention, provision is made for this element connecting the two cannulas to take the form of a flexible hose. When the sliding members are in a state in which they are moved relatively toward one another, the hose is laid in a relatively large arch between the cannulas. Once the sliding members move apart, the arch flattens off. It would also be possible, for example, to guide the cannulas telescopically one inside the other in a sealed manner.

According to one particular design, provision is made for at least one bevel of the actuating means to be adjoined by a portion of the actuating means that is arranged parallel to an end portion of the sliding member which is assigned to said actuating means. On actuating the actuating means, the interaction between the bevels of the actuating means and of the assigned sliding member causes the sliding member to be displaced and the bevel of the actuating means passes into an intermediate position out of engagement with the bevel of the sliding means. Further actuation of the actuating means causes the parallel portions of the actuating element and sliding member to slide against one another, with the result that no further advancing movement of the sliding member is produced by the actuating means. While this further advancing movement of the actuating means is taking place, the other sliding member can be displaced by the actuating means. In this case, after previously parallel portions of this sliding member and the actuating means have interacted and no adjusting movement of this sliding member has taken place, the bevels of this sliding member and the actuating means are actively engaged.

It is considered to be particularly advantageous for the sliding members to be in contact with one another when they are in their fully inserted position in the body.

The sliding members are formed in a structurally simple manner if they have a circular cross section outside their region containing the bevels. In a corresponding manner, the body which accommodates the sliding members is provided with a cross-sectionally circular passage between the holders for the two containers.

Further features of the invention are represented in the subclaims, in the description of the figures and in the figures themselves, while it is noted that all individual features and all combinations of individual features constitute further inventive embodiments.

Figure 2:
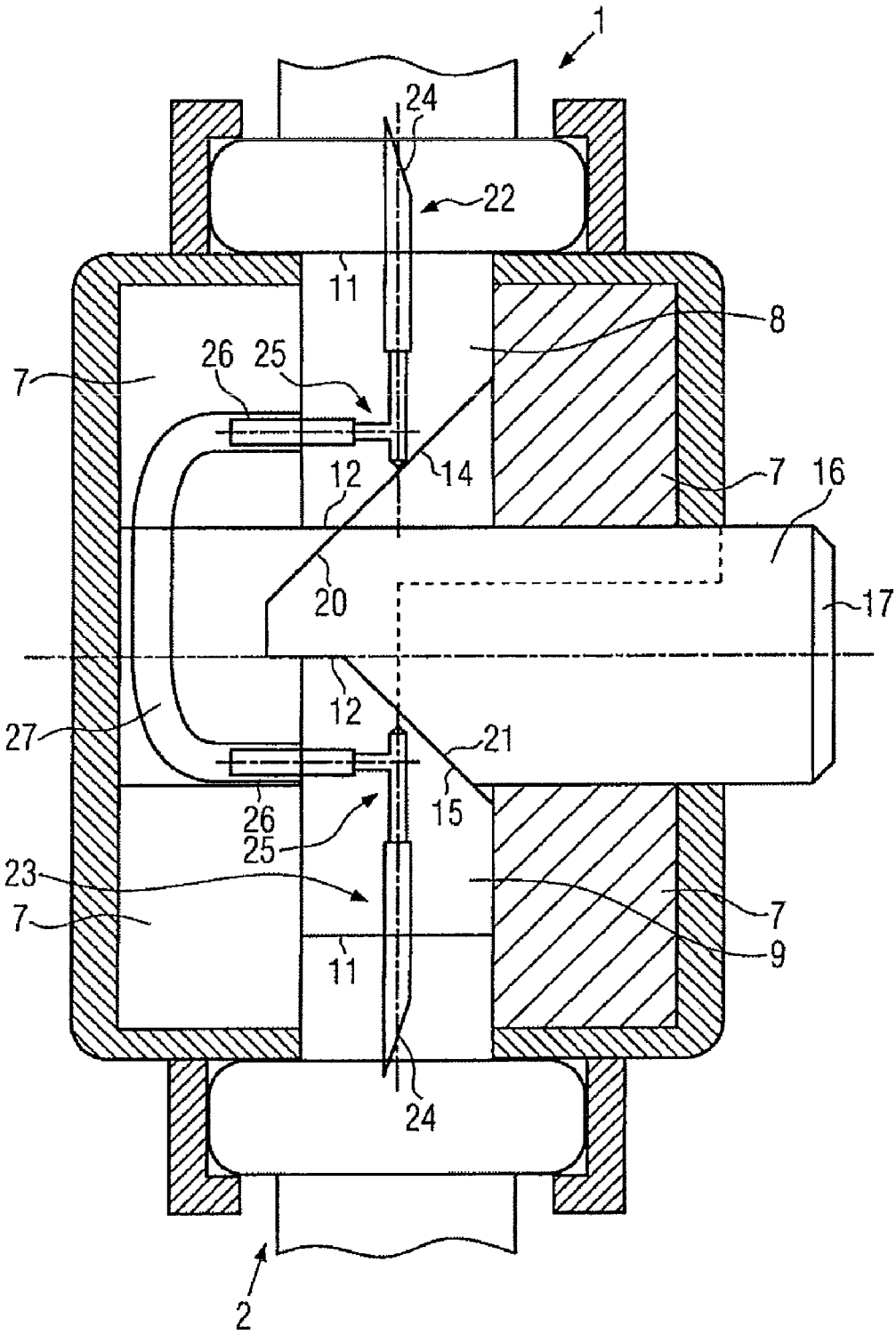
Figure 3:
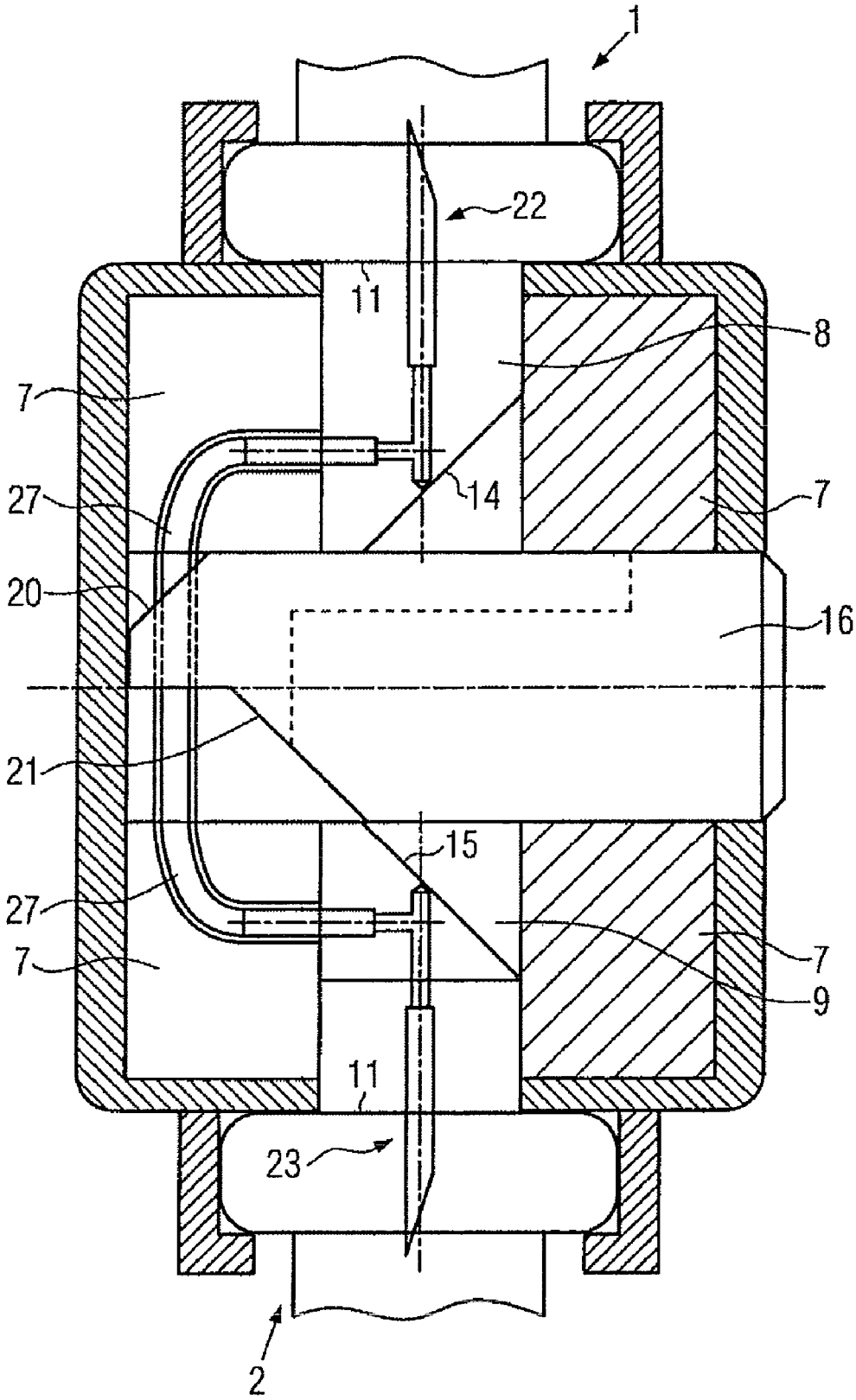

An exemplary embodiment is explained in more detail below with reference to the drawings, in which:

FIG. 1 shows a longitudinal center section through the device according to the invention for combining components, illustrated for the preassembled transfer system, in the initial position before activating the transfer system, FIG. 2 shows a device according to FIG. 1, with the solvent side punctured, but with no transfer of the aqueous solution having yet taken place, FIG. 3 shows a representation according to FIGS. 1 and 2, with the solvent side and vacuum side punctured, and with the solvent transferred.

The device serves for combining a first liquid component—solvent—and a second solid or liquid component by means of negative pressure under sterile conditions. It is thus intended to transfer the solvent, which is arranged inside a bottle 1 having a rotationally symmetrical shape, into a second bottle 2, likewise having a rotationally symmetrical shape, which holds the solid or liquid component which is to be mixed with the solvent of the first bottle.

The respective bottle 1 or 2 has a bottle head 3 or 4: a rubber stopper is plugged into the respective bottle head to close it. The rubber stopper is retained, for example, by means of a crimp cap which encloses the bottle head 3 or 4 and which is in contact with said rubber stopper in the edge region. Negative pressure or vacuum conditions prevail inside the bottle 2.

The device for combining the components contained in the bottles 1 and 2 comprises a rotationally symmetrical housing 5 in the form of a hollow body which is provided with latching holders 6 in the region of diametrical ends. The bottles 1 and 2 can be fitted into these latching holders 6 by way of their bottle heads 3 and 4, with the result that the bottle heads 3 and 4, or the closure stoppers plugged into them, face one another.

In the housing 5 are arranged guiding inserts 7 which are mounted immovably in the housing 5 and which serve to guide two sliding members 8 and 9. The respective sliding member 8 or 9 has a rotationally symmetrical design and is guided in the region of its lateral surface 10 by means of the guiding inserts 7. Each sliding member 8 or 9 is provided at its ends with parallel surfaces 11 and 12. The longitudinal center axis of the sliding members 8, 9, which is coincident, is designated by the reference number 13. The sliding members 8 and 9 have, on the same side, bevels 14 and 15 and these bevels can be operatively engaged by an actuating plunger 16 which passes through the housing 5 laterally, that is to say perpendicularly to the longitudinal center axis 13. This actuating plunger 16 is guided in the guiding inserts 7 and projects from the housing 5. There, the actuating plunger 16 is provided with a planar actuating surface 17 which extends parallel to the longitudinal center axis 13.

The actuating plunger 16 has a rotationally symmetrical design. Its longitudinal center axis is designated by the reference number 18 and its lateral surface, in the region of which the actuating plunger 16 is guided in the guiding inserts 17, is designated by the reference number 19.

In the region of its end which projects into the interior of the housing 5, the actuating plunger 16 is provided with two bevels 20 and 21; the bevel 20 can be actively engaged with the bevel 14 of the sliding member 8 and the bevel 21 can be actively engaged with the bevel 15 of the sliding member 9. The two bevels 20 and 21 run into the lateral surface 19 of the actuating plunger 16. The bevels 20 and 21 are offset with respect to one another relative to the longitudinal extent of the longitudinal center axis 18, which means that the leading bevel 20 as viewed in the pushing-in direction of the actuating plunger 16 makes contact with the bevel 14 of the sliding member 8 earlier than the trailing bevel 21 of the actuating plunger 16 makes contact with the bevel 15 of the sliding member 9.

The respective sliding member 8 or 9 accommodates a cannula 22 or 23 for piercing the respective closure stopper of the bottle 1 or 2, wherein the cannula 22 or 23 is fixedly mounted in the sliding member 8 or 9. The puncture tip of the respective cannula 22 or 23 is designated by the reference number 24. In the region of its end facing away from the puncture tip 24, the respective cannula 22 or 23 opens into an angled duct 25 incorporated into the respective sliding member 8 or 9, wherein a small tube 26 projecting from the sliding member 8 or 9 is fitted in a sealed manner into that portion of the angled duct 25 which extends perpendicularly to the longitudinal center axis 13 of the housing 5. A flexible hose 27 is fitted onto the two tubes 26, which project on the same side of the housing 5 from the sliding member 8 or 9. There is thus formed a transfer-flow connection from the puncture tip 24 of the cannula 22 via the angled duct 25 assigned to said cannula 22, via the tube 26 assigned to said angled duct, via the hose 27, via the other tube 26 assigned to the hose 27, via the angled duct 25 of the sliding member 9 and via the cannula 23 to its puncture tip 24.

The way in which the transfer system according to the invention operates is as follows:

The two glass bottles 1 and 2 are preassembled and then fitted into the latching holder 6. One preparation bottle 1 contains aqueous solution. The other preparation bottle 2, which is provided with vacuum and filled with active substance in powder or liquid form, is inserted diametrically with respect to the bottle 1 into the latching holder 6 there of the housing 5. In this preassembled position of the transfer system, which is illustrated in FIG. 1, the puncture tips 24 of the cannulas 22, 23 are arranged at a slight distance from the closure stopper of the bottles 1 and 2.

Before using the device, the latter is positioned such that the bottle 1 filled with the aqueous solution is at the top and the bottle 2 under vacuum is at the bottom. The longitudinal center axis 13 thus extends substantially vertically.

Transferring the liquid from the bottle 1 is initiated by actuating the actuating plunger 16 from outside the housing 5. Actuating the actuating plunger 16 causes the sliding member 8 to be pushed upward, and hence the cannula 22 to be moved upward, as a result of the bevels 14 and 20 of the sliding member 8 and actuating plunger 16 sliding against one another. In the process, the cannula 22 pierces the rubber stopper plugged into the bottle head 3 of the bottle 1 until the cannula 22 passes by way of its puncture tip 24 behind the rubber stopper and thus into the inside of the bottle, thereby establishing a flow connection between the bottle 1 and cannula 22. This end position of the sliding member 8, which constitutes the intermediate position when actuating the device for the purpose of transferring the liquid, is illustrated in FIG. 2. In this position, the liquid has not yet been transferred.

In a second step, the actuating plunger 16 is pushed further into the inside of the housing 5. In so doing, the sliding member 8 does not move any further in the direction of the bottle 1 since the bevels 14 and 20 are now no longer active; instead, the lateral surface 19 of the actuating plunger 16 slides along the surface 12 of the sliding member 8. During this further movement of the actuating plunger 16, the bevel 21 of the actuating plunger 16 that trails with respect to the bevel 20 now comes into contact with the bevel 15 of the sliding member 9, with the result that the sliding member 9 is displaced downward. In the process, the puncture tip 24 of the cannula 23 penetrates the closure stopper, piercing the bottle 2 under vacuum. In the end position of the sliding member 9, the puncture tip 24 of the cannula 23 is situated behind the closure stopper of the bottle 2, thereby establishing a flow connection between the cannula 23 and the inside of the bottle 2. Owing to the vacuum in the bottle 2, the liquid from the bottle 1 is channeled via the above-described flow path between the cannulas 22 and 23, and hence also via the flexible hose 27, into the bottle 2 and mixes with the liquid or solid substance contained therein. This end state is illustrated in FIG. 3.

LIST OF REFERENCE NUMBERS

Bottle 1
Bottle 2
Bottle head 3
Bottle head 4
Housing 5
Latching holder 6
Guiding insert 7
Sliding member 8
Sliding member 9
Lateral surface 10
Surface 11
Surface 12
Longitudinal center axis 13
Bevel 14
Bevel 15
Actuating plunger 16
Actuating surface 17
Longitudinal center axis 18
Lateral surface 19
Bevel 20
Bevel 21
Cannula 22
Cannula 23
Puncture tip 24
Angled duct 25
Small tube 26
Hose 27

The invention claimed is:

1. A device for combining a first liquid component and a second solid or liquid component by means of negative pressure under sterile conditions, said device comprising: a first container which holds the first component; a second container which holds the second component and is under negative pressure, a body having a first holder for the first container in a region of first container closure and a second holder for the second container in a region of a second container closure, displaceable means arranged inside the body which are configured for piercing the closures and which comprise at least one cannula, wherein the body comprises two sliding members which are slidingly mounted therein, wherein each sliding member accommodates at least one cannula for piercing the respective closure, wherein the cannulas are connected, in the region of their ends which face away from the closures, to an element which connects the cannulas in a liquid-tight manner, and actuating means are provided for moving the sliding members in the direction of the closures for the purpose of piercing the closures.

2. The device as claimed in claim 1, wherein the element connecting the two cannulas takes the form of a flexible hose.

3. The device as claimed in claim 1 or 2, wherein the two sliding members are mounted in a diametrically displaceable manner in the body.

4. The device as claimed in claim 1, wherein a working axis of the actuating means is arranged approximately perpendicularly to an adjusting axis of the sliding members.

5. The device as claimed in claim 1, wherein the actuating means is provided at its front end with bevels which interact with bevels of the sliding members.

6. The device as claimed in claim 5, wherein the sliding members are of identical design and the actuating means has identical bevels which are arranged with an offset in an adjusting direction of the actuating means.

7. The device as claimed in claim 5, wherein at least one bevel of the actuating means is adjoined by a portion of the actuating means that is arranged parallel to an end portion of the sliding member which faces said actuating means.

8. The device as claimed in claim 5, wherein the sliding members have a circular cross section outside the region containing the bevels.

9. The device as claimed in claim 1, wherein the sliding members are in contact with one another when they are in their fully inserted position in the body.

10. The device as claimed in claim 1, wherein, with the sliding members in the fully inserted position in the body and with the containers fitted into the body, the cannulas are arranged at a small distance from the closures of the containers.

11. The device as claimed in claim 1, wherein the respective container is held in the body by means of a latching mechanism.

* * * * *